US006279165B1

(12) United States Patent
Kobayashi

(10) Patent No.: US 6,279,165 B1
(45) Date of Patent: Aug. 28, 2001

(54) GRIPPING GLOVE

(75) Inventor: Mineko Kobayashi, Yoshikawa (JP)

(73) Assignee: Kabushiki Kaisha Kohchi (JP)

( * ) Notice: Subject to any disclaimer, the term of this patent is extended or adjusted under 35 U.S.C. 154(b) by 0 days.

(21) Appl. No.: 09/577,864

(22) Filed: May 24, 2000

(51) Int. Cl.[7] ..... A41D 19/00
(52) U.S. Cl. ..... 2/163; 2/16; 2/161.1; 2/161.6
(58) Field of Search ..... 2/163, 158, 159, 2/161.1, 161.6, 16, 20, 167

(56) References Cited

U.S. PATENT DOCUMENTS 2,735,108 * 2/1956 Cremer ..... 2/158
3,683,420 * 8/1972 Vilain ..... 2/161
4,534,066 * 8/1985 Hansson ..... 2/163
4,916,757 * 4/1990 Berlin et al. ..... 2/159

* cited by examiner

*Primary Examiner*—John J. Calvert
*Assistant Examiner*—Katherine Moran
(74) *Attorney, Agent, or Firm*—Adams & Wilks

(57) ABSTRACT

A glove formed of a thick heat-resisting sheet or a waterproof sheet is provided with a sack portion for thumb and a sack portion for forefinger and, in addition, with a common sack portion formed in a one-piece unit for putting in the third finger, fourth finger, and fifth finger, together, and, in the meanwhile, the angles α and β formed between the center lines of the sack portions are set 40–50° and 25–35° so that the sack portions are rendered conformable to the shapes of the fingers that are naturally opened and hence the glove can be easily put on the hand.

11 Claims, 4 Drawing Sheets

GRIPPING GLOVE

BACKGROUND OF THE INVENTION

1. Field of the Invention

The present invention relates to a gripping glove favorably used for gripping such things as high-temperature cooking utensils in a kitchen, heat-treated members in high temperature in a factory, or high-voltage electric cables.

2. Description of the Related Art

While a pair of gloves made of thick materials are conventionally used for gripping such a thing as a heated cooking utensil up to a high temperature in a kitchen oven, that of a mitten type (refer to FIG. 4) employed to enable quick putting on and off of the gloves.

Namely, such a glove is in general use that has a thumb receptacle or sack portion a for putting in the thumb and a common sack portion b for putting in all other fingers together.

While the shape of above described conventional mitten-type glove enables is to be quickly put on and off, when used for gripping such things as high-temperature members and high-tension cables, it is difficult to produce a firm gripping action, and there is a tendency that the gripping action is produced only by having the common sack portion b turned down toward the palm side.

SUMMARY OF THE INVENTION

Accordingly, it is an object of the present invention to provide a gripping globe arranged such that a firm gripping action of a member is produced safely by the third, fourth, and fifth fingers, receiving suitable assistance in supplementing the gripping force from the thumb and the forefinger, and that the action needed to put the glove on the hand is quickly performed.

In order to attain the above mentioned object, the gripping glove of the present invention comprises a sack portion for accommodating a thumb and a sack portion for accommodating forefinger arranged independently of each other for accommodating in the thumb and the forefinger, respectively, and a common sack portion formed in a one-piece unit for accommodating the third finger, fourth finger, and fifth finger, together, arranged separately from the sack portion for the forefinger.

Further, the gripping glove of the invention is characterized by that, when it is in its non-used and flattened state, the angle formed between the center line of the sack portion for thumb and the center line or control axis of the sack portion for forefinger is set between 40 and 50° and the angle formed between the center line of the sack portion for forefinger and the center line of the common sack portion is set between 25 and 35°.

Further, the gripping glove of the invention is characterized by having surfaces processed for preventing occurrence of slippage on the palm side of the sack portions.

In the above described gripping glove of the invention, there are the sack portion for thumb and the sack portion for forefinger arranged separately from each other for putting in the thumb and the forefinger, respectively, and, in addition, a common sack portion formed in a one-piece unit for putting in the third finger, fourth finger, and fifth finger, together, arranged separately from the sack portion for the forefinger. Therefore, when used allows the user the glove to grip firmly a high-temperature member or the like with the common sack portion turned down toward the palm side. At this time, especially because the sack portion for the thumb and the sack portion for the forefinger give cooperative assistance in the gripping action, it is made possible to more firmly grip the high-temperature member, a high-tension cable, or the like. Thus, serviceability of the gripping glove of the invention becomes greatly improved.

Since, when the glove is in its non-used and flattened state, the angle formed between the center line of the sack portion for the thumb and the center line of the sack portion for the forefinger is set between 40 and 50° and the angle formed between the center line of the sack portion for the forefinger and the center line of the common sack portion is set between 25 and 35°, the relative positions of the sack portions are rendered conformable to the shapes of the fingers that are naturally opened. Hence, when the glove is used, the operation to put it on the hand with the fingers inserted into their respective sack portions can be performed quickly, and this is especially helpful for a cook when hurried during operating an oven or using a frying pan in the kitchen or for a worker when gripping a high-voltage electric cable at a height.

Further, since there are provided surfaces processed for preventing occurrence of slippage on the surface of the sack portions on the palm side, the gripping operation by the glove can be performed more firmly and this contributes to an improvement in safety.

DESCRIPTION OF THE PREFERRED EMBODIMENTS

Figure 1:
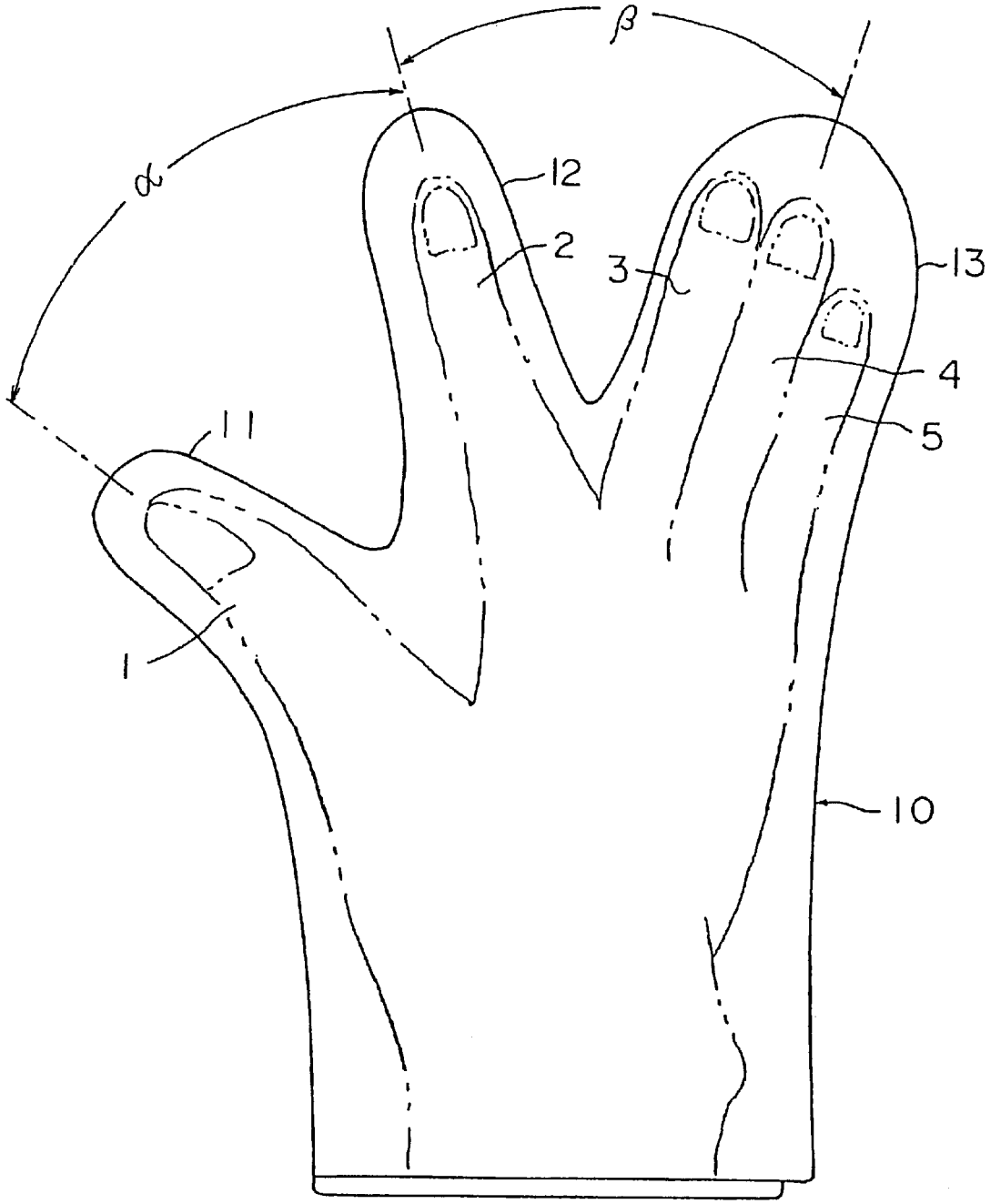
FIG. 1 is a plan view showing the back side of a gripping glove in accordance with a first embodiment of the invention.
Figure 2:
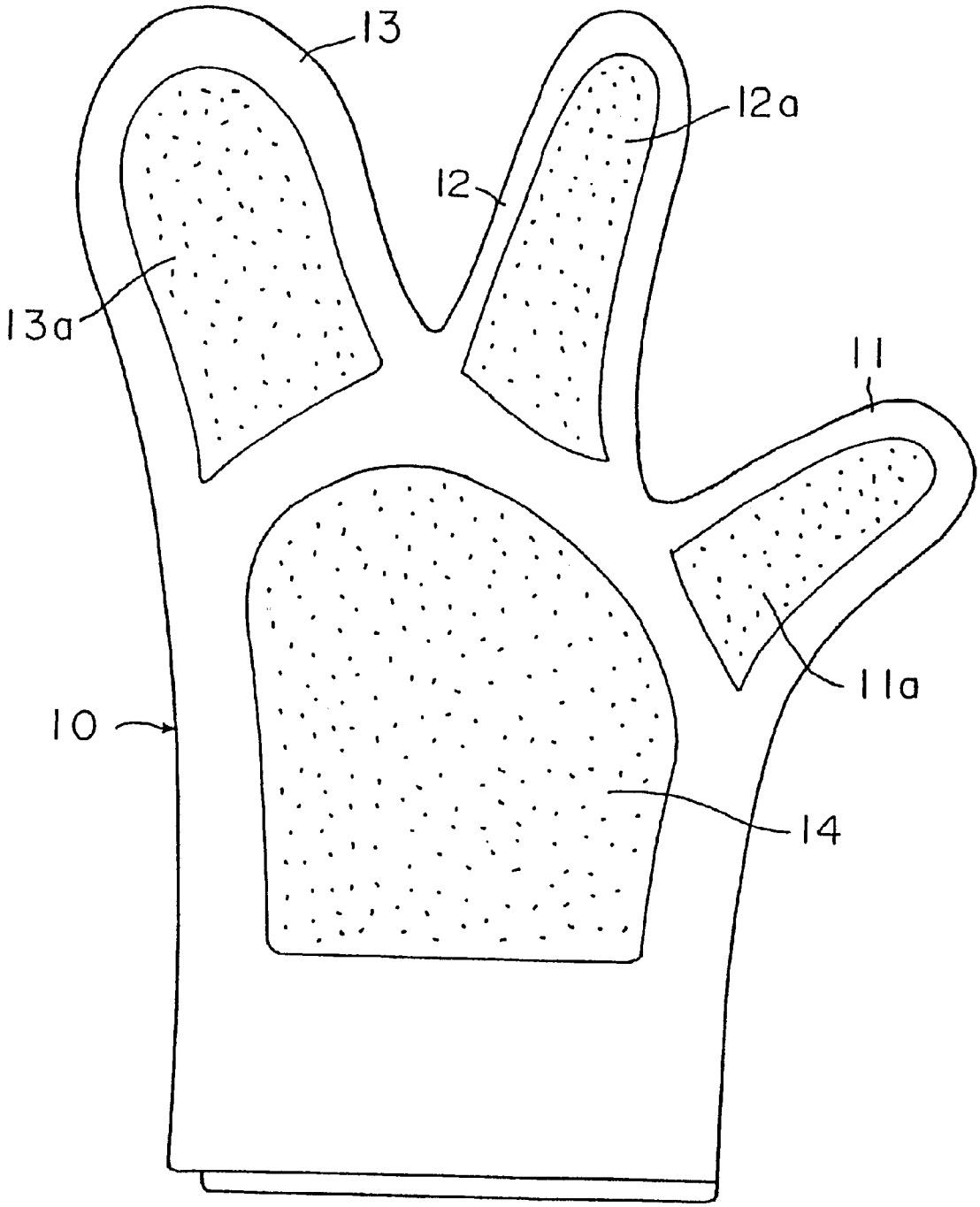
FIG. 2 is a plan view showing the palm side of the gripping glove of FIG. 1.
Figure 3:
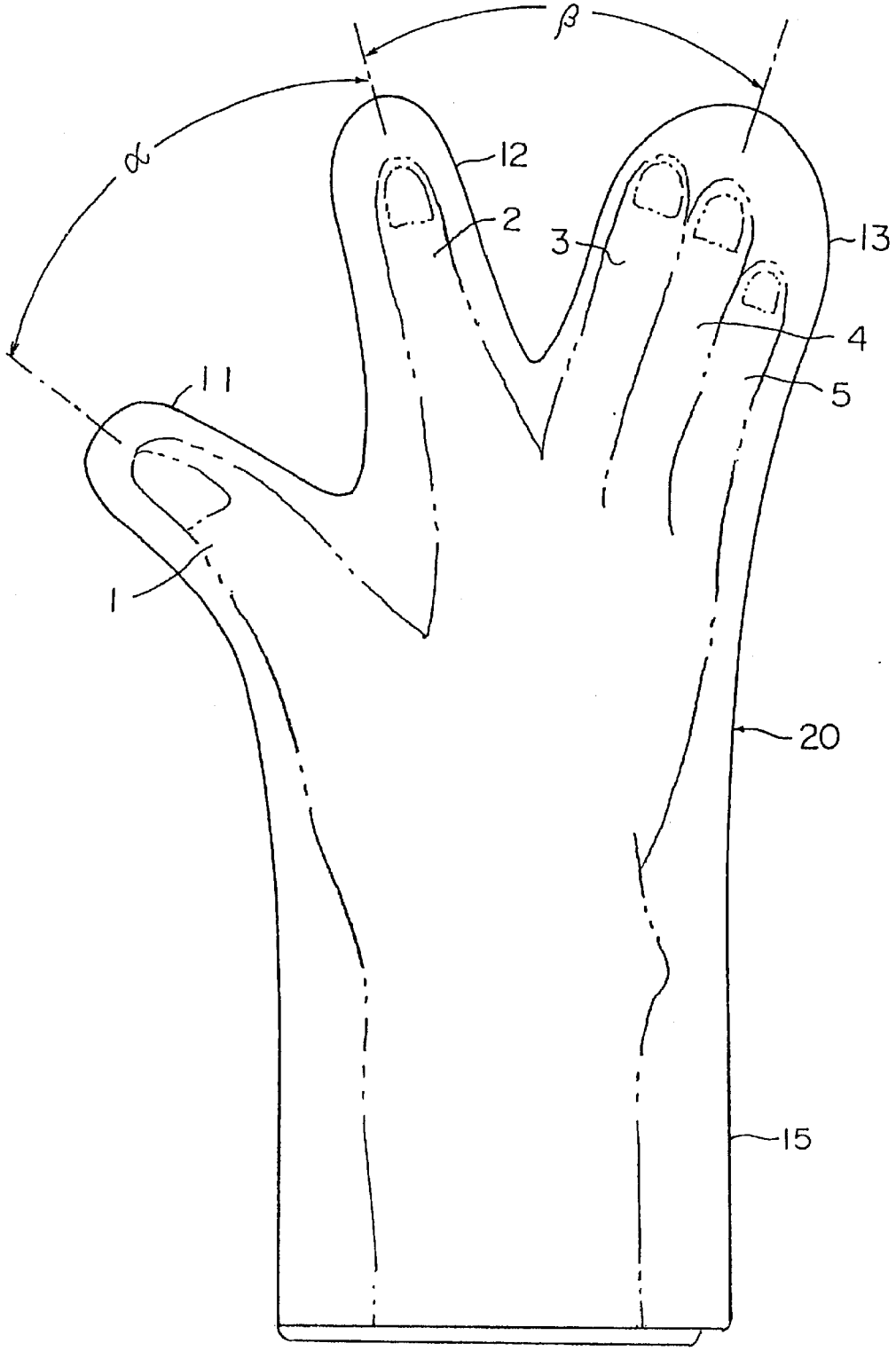
FIG. 3 is a plan view showing the back side of a gripping glove in accordance with a second embodiment of the invention.
Figure 4:
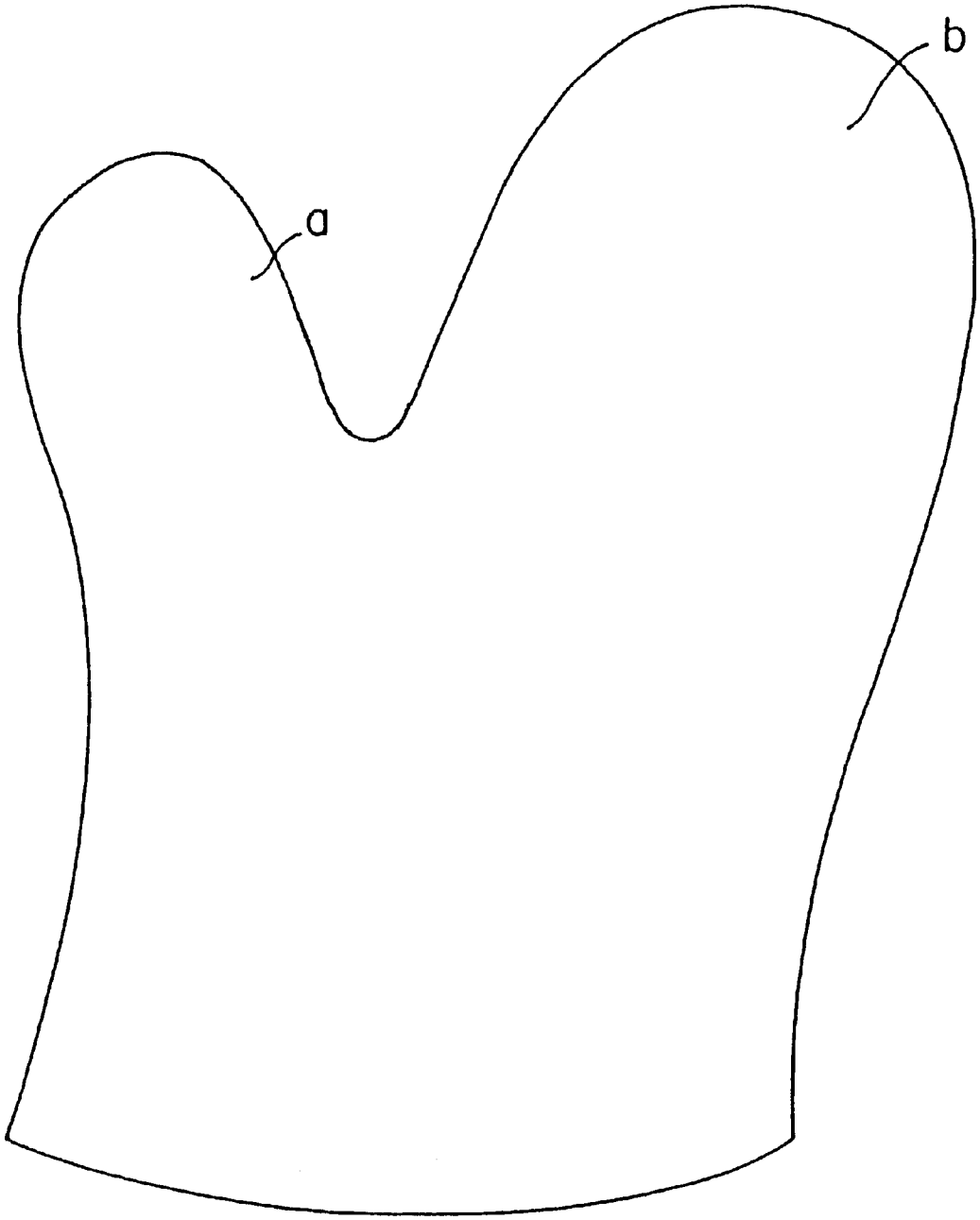
FIG. 4 is a plan view showing the back side of a gripping glove of the related art.

Embodiments of the present invention will be described with reference to the accompanying drawings. FIGS. 1 and 2 are drawings showing a gripping glove in accordance with a first embodiment of the invention, of which FIG. 1 is a plan view showing the back side and FIG. 2 is a plan view showing the palm side. FIG. 3 is a plan view showing the back side of a gripping glove in accordance with a second embodiment of the invention.

The first embodiment of the invention will be described. As shown in FIG. 1, a glove 10 for the right hand made of a sheet material such as a heat-resisting thick fabric is provided with a sack portion for thumb 11 and a sack portion for forefinger 12 arranged independent of each other for putting in the thumb 1 and the forefinger 2, respectively, and with a common sack portion 13 formed in a one-piece unit for putting in the third finger 3, fourth finger 4, and fifth finger 5, together. Further, the common sack portion 13 is arranged separate from the sack portion for forefinger 12. In addition, there is provided a glove for the left hand, not shown, in mirror image fashion to the glove 10 for the right hand.

When the glove 10 is in its non-used and flattened state, the sack portions 11, 12, 13 lie in the same plane and the angle $\alpha$ formed between the center line of the sack portion for thumb 11 and the center line of the sack portion for forefinger 12 is set between 40 and 50° (preferably at 45° ) and the angle β formed between the center line of the sack portion for forefinger 12 and the center line of the common sack portion 13 is set between 25 and 35° (preferably at 30°).

Further, on the surface of the sack portions 11–13 of the glove 10 on the palm side, there are surfaces processed so as to prevent occurrence of slippage, such as rough-surfaced sheets, 11*a*, 12*a*, and 13*a*, respectively, as shown in FIG. 2 and, according to the need, a processed surface 14 for preventing slippage is also provided on the surface corresponding to the palm.

In the above described gripping glove of the invention, there are the sack portion for thumb 11 and the sack portion for the forefinger 12 arranged separate from each other for putting in the thumb 1 and the forefinger 2, respectively, and, in addition, a common sack portion 13 formed in a one-piece unit for putting in the third finger 3, fourth finger 4, and fifth finger 5, together, arranged separate from the sack portion for the forefinger 12. Therefore, when used the glove allows the user to firmly grip a high-temperature member with the common sack portion 13 turned down toward the palm side. At this time, especially because the sack portion for thumb 11 and the sack portion for the forefinger 12 give cooperative assistance in the gripping action, it is made possible to grip more firmly the high-temperature member. Thus, serviceability of the gripping glove as that for gripping a high-temperature member becomes greatly improved.

Since, when the glove 10 is in its non-used and flattened state, the angle formed between the center line of the sack portion for thumb 11 and the center line of the sack portion for forefinger 12 is set between 40 and 50° and the angle formed between the center line of the sack portion for forefinger 12 and the center line of the common sack portion 13 is set between 25 and 35°, relative positions of the sack portions 11–13 are rendered conformable to the shapes of the fingers that are naturally opened. Hence, when the glove is used, the operation to put it on the hand with the fingers inserted into their respective sack portions 11–13 can be performed quickly, and this is quite helpful especially for a cook when operating an oven or using a frying pan in the kitchen and for a worker when firmly gripping a member treated in high temperature in a factory.

Further, since there are provided surfaces processed for preventing occurrence of slippage 11*a*, 12*a* and 13*a* on the surface of the sack portions 11–13 on the palm side, gripping of a high-temperature member with the use of the glove 10 can be made more firmly and this contributes to improvement in safety.

Now a gripping glove as a second embodiment of the invention will be described. As shown in FIG. 3, a glove 20 for the right hand made of a rubber sheet or a plastic sheet is provided with a sack portion for the thumb 11 and a sack portion for the forefinger 12 independently of each other for putting in the thumb 1 and the forefinger 2, respectively, and with a common sack portion 13 formed in a one-piece unit for putting in the third finger 3, fourth finger 4, and fifth finger 5, together. The common sack portion 13 is arranged separate from the sack portion for forefinger 12. In addition, there is provided a glove for the left hand, not shown, in mirror image fashion to the glove 20 for the right hand.

Also with the glove 20, when it is in its non-used and flattened state, the angle α formed between the center line of the sack portion for thumb 11 and the center line of the sack portion for forefinger 12 is set between 40 and 50° (preferably at 45°) and the angle β formed between the center line of the sack portion for forefinger 12 and the center line of the common sack portion 13 is set between 25 and 35° (preferably at 30°).

Further, since this glove 20 is formed of a water-proof sheet to be used also for scrubbing and washing, the skirt portion 15 forming the inlet and outlet of the hand is made longer to make it difficult for water to get inside.

While virtually the same effects as those obtained from the first embodiment can be obtained from the gripping glove of the above described second embodiment, because a rubber sheet or a plastic sheet is used as the material of the glove, it has a further effect that it can be conveniently used for scrubbing and washing.

Meritorious effects of the invention are summarized as follows:

(1) Since there are the sack portion for the thumb and the sack portion for the forefinger arranged separate from each other for putting in the thumb and the forefinger, respectively, and, in addition, a common sack portion formed in a one-piece unit for putting in the third finger, fourth finger, and fifth finger, together, arranged separate from the sack portion for the forefinger, it when used allows the user to grip a high-temperature member or the like firmly with the common sack portion turned down toward the palm side. At this time, especially because the sack portion for thumb and the sack portion for forefinger give cooperative assistance in the gripping action, it is made possible to perform the gripping action more firmly. Thus, serviceability of the gripping glove of the invention becomes greatly improved.

(2) Since, when the glove is in its non-used and flattened state, the angle formed between the center line of the sack portion for thumb and the center line of the sack portion for the forefinger is set between 40 and 50° and the angle formed between the center line of the sack portion for the forefinger and the center line of the common sack portion is set between 25 and 35°, the relative positions of the sack portions are rendered conformable to the shapes of the fingers that are naturally opened. Hence, when the glove is used, the operation to put it on the hand with the fingers inserted into their respective sack portions can be performed quickly, and this is quite helpful especially for a cook when hurriedly operating an oven or using a frying pan in the kitchen.

(3) Further, since there are provided surfaces processed for preventing occurrence of slippage on the surface of the sack portions on the palm side, gripping operation by the glove can be performed more firmly and this contributes to improvement in safety.

What is claimed is:

1. A gripping glove for gripping a hot cooking utensil, comprising: a hand accommodating portion; a first finger receptacle extending from the hand accommodating portion for accommodating a thumb; a second finger receptacle extending from the hand accommodating portion for accommodating a forefinger and being formed separately from the first finger receptacle; and a third finger receptacle extending from the hand accommodating portion for accommodating third, fourth and fifth fingers and being formed separately from the first and second receptacles; wherein the hand accommodating portion and the first, second and third finger receptacles are formed of a heat resistant material sufficient to isolate the hand from the heat produced by a hot cooking utensil; wherein a first angle formed between a central axis of the first receptacle and a central axis of the second receptacle is set between 40° and 50° and a second angle formed between a central axis of the second receptacle and a central axis of the third receptacle is set between 25 and 35°; and wherein the first, second and third receptacles lie in the same plane when the glove is in a relaxed state.

2. A gripping glove according to claim 1; wherein surfaces of the receptacles on a palm side of the glove are processed to prevent slippage.

3. A gripping glove according to claim 1; further comprising processed surfaces for preventing slippage disposed on a palm side of the receptacles.

4. A gripping glove according to claim 1; wherein the first angle is set at 45° and the second angle is set at 30°.

5. A gripping glove according to claim 1; further comprising textured films formed on surfaces of a palm side of the glove including the receptacles.

6. A gripping glove according to claim 1; wherein the glove is formed of rubber.

7. A gripping glove according to claim 1; wherein the hand accommodating portion is configured to cover a palm of the hand, and from which the first, second and third receptacles extend.

8. A glove for gripping an object, comprising: a hand accommodating portion for covering a palm of a hand inserted into the glove; a first finger receptacle extending from the hand accommodating portion for accommodating a thumb; a second finger receptacle extending from the hand accommodating portion for accommodating an index finger; and a third finger receptacle extending from the hand accommodating portion for accommodating the other three fingers of the hand; wherein the first, second and third receptacles are separate from each other and lie in the same plane when the glove is in a relaxed state, the hand accommodating portion and the first, second and third finger receptacles are formed of a heat resistant material sufficient to isolate the hand from a heated object gripped by the glove, a first angle formed between a central axis of the first finger-receptacle and a central axis of the second finger receptacle is set between 40° and 50° and a second angle formed between a central axis of the second finger receptacle and a central axis of the third finger receptacle is set between 25 and 35°.

9. A glove according to claim 8; wherein surfaces of the finger receptacles on a palm side of the glove are processed to prevent slippage.

10. A glove according to claim 9; wherein the first angle is set at 45° and the second angle is set at 30°.

11. A glove according to claim 9; further comprising textured films formed on surfaces of a palm side of the glove including the receptacles.

* * * * *